United States Patent [19]

Corner

[11] Patent Number: 5,033,206

[45] Date of Patent: Jul. 23, 1991

[54] VACUUM DRYING MACHINE WITH MULTIPLE TABLES FOR INDUSTRIAL HIDES AND SIMILAR PRODUCTS

[75] Inventor: Antonio Corner, Thiene, Italy

[73] Assignee: Officine di Cartigliano S.p.A., Vicenza, Italy

[21] Appl. No.: 460,553

[22] Filed: Jan. 3, 1990

[30] Foreign Application Priority Data

Feb. 15, 1989 [IT] Italy ..... 85527 A/89

[51] Int. Cl.[5] ..... F26B 13/30

[52] U.S. Cl. ..... 34/92; 34/144

[58] Field of Search ..... 34/242, 15, 92, 144, 34/145, 146

[56] References Cited

U.S. PATENT DOCUMENTS

| | | | |
|---|---|---|---|
| 1,536,163 | 5/1925 | Sutherland . | |
| 1,854,341 | 4/1932 | Laussucq . | |
| 1,907,207 | 5/1933 | Laussucq . | |
| 3,126,578 | 3/1964 | Chapman | 34/145 |
| 3,438,137 | 4/1969 | Archer . | |
| 3,460,269 | 8/1969 | Kessler | 34/92 |
| 3,667,626 | 6/1972 | Torelli et al. | 34/242 |
| 3,668,819 | 6/1972 | Henshaw . | |
| 4,480,990 | 11/1984 | Beam et al. | 34/144 |

*Primary Examiner*—Henry A. Bennett
*Assistant Examiner*—Denise L. F. Gromada
*Attorney, Agent, or Firm*—Wenderoth, Lind & Ponack

[57] ABSTRACT

The present invention relates to a vacuum drying machine with multiple tables for drying industrial hides and similar products, including a fixed supporting frame which supports a plurality of controllably vertically movable horizontal work tables. Each of the tables has, on its upper face, a supporting and heating plate for supporting and heating the hides and, on its lower face, a closing cover which can sealingly engage the upper face of the underlying table so as to define a vacuum drying chamber. An intermediate supporting structure is provided so as to be vertically movable inside the fixed supporting frame. The tables are vertically movable in the intermediate supporting structure so as to move telescopingly with respect to the fixed supporting frame.

17 Claims, 4 Drawing Sheets

VACUUM DRYING MACHINE WITH MULTIPLE TABLES FOR INDUSTRIAL HIDES AND SIMILAR PRODUCTS

BACKGROUND OF THE INVENTION

1. Field of the Invention

The present invention relates to a vacuum drying machine with multiple tables for drying industrial hides and similar products.

Drying machines of this kind generally comprise a fixed supporting frame and a plurality of horizontal work tables which are controllably vertically movable with respect to the fixed supporting structure. Each of said tables has, on its upper face, a supporting and heating plate for supporting and heating the hides and, on its lower face, a closure lid which can sealingly engage with the supporting plate of the underlying table. The coupling between each lid and the related underlying table defines an evaporation chamber in which the hides being dried are placed.

2. Description of the Related Art

In known drying machines, see for example WO-A-8705944, said tables are commonly moved vertically by pairs of single- or double-action hydraulic cylinders arranged in positions adjacent to the uprights of the supporting frame.

In said machines, the jackets of the hydraulic cylinders are fixed to the base of the supporting frame, while the ends of their piston rods are connected to the respective tables by means of appropriate connecting elements. Said known movement systems have several advantages, but they are not free from some disadvantages, the main one of which is that very long cylinders must be used in order to achieve the required work strokes, with jackets which are sometimes so long that they have to be accommodated in corresponding cavities provided in the ground. Said machines, once installed, consequently cannot be easily transferred without entailing high costs.

In other known kinds of drying machines, an attempt has been made to obviate the above-described disadvantage by providing every table with a pair of double-action linear cylinders and movable jackets, in which said jackets are connected to the lateral ends of the tables, while the piston rods are fixed to the upper ends of the respective uprights of the supporting frame. With this solution, the cylinders thus hang from the respective piston rods and it is therefore not necessary to provide appropriate cavities in the ground to accommodate them. However, even in this solution there is the disadvantage of a considerable vertical extension of the machine, with evident limitations as to the maximum number of usable tables which, for practical reasons, cannot normally be more than four. This limitation severely affects the productive requirements of the drying cycle. In order to optimize the use of personnel in the drying process, it is in fact convenient to increase the time required to place hides on all of the work tables so that this time is not shorter than the time over which a vacuum is maintained in the evaporation chamber. In known machines which have a reduced number of tables, the hide placing operation requires considerably less time than the hide evaporation operation, so that there is an inefficient use of personnel, with a consequent loss in the economy of the production cycle.

Another aspect related to the limitation of the maximum number of tables of a machine is constituted by the final quality of the hides at the end of the drying process, which depends to a large extent on the vacuum drying times. In fact it is known that the prolongation of said times allows for a reduction in other parameters of the process, such as for example the temperature or the degree of vacuum, which negatively affect the structure of the treated product if they are excessively high. In the drying machines of the prior art the treated product's quality cannot therefore be improved without negatively affecting the economy of the production cycle.

A further disadvantage of conventional drying machines resides in the large number of parts which constitute the movement devices, which entail high costs for the production and assembly of the machine and give rise to considerable maintenance expenses for the necessary large number of spare parts which must be kept in stock.

A further disadvantage of said machines is constituted by their great bulk and by the difficult transportability of the parts which compose the supporting structure. This is mostly due to the movement systems commonly employed, which normally extend along the entire height of the machine and must therefore be integrated in the uprights of the supporting structure.

SUMMARY OF THE INVENTION

The aim of the present invention is to eliminate the disadvantages described above by providing a vacuum drying machine which meets production and product quality requirements.

Within the scope of the above described aim, a particular object of the invention is to provide a drying machine with a considerably larger number of tables than the prior art, so as to optimize the use of the assigned personnel.

Another object of the present invention is to provide a machine which requires a reduced number of parts composing the handling system, so as to be economically advantageous and easy to maintain.

A further object of the present invention is to provide a machine with small dimensions in order to contain transport and transfer costs.

Another object of the present invention is to provide a machine which is easily associable with any automatic system for loading and unloading the hides, so as to increase the system's productivity.

Not least, still another object of the present invention is to provide a machine which is highly reliable and safe despite the large number of work tables.

BRIEF DESCRIPTION OF THE DRAWINGS

Further characteristics and advantages of the invention will become apparent from the description of a preferred but not exclusive embodiment of a vacuum drying machine, illustrated only by way of non-limitative example in the accompanying drawings, wherein.

DETAILED DESCRIPTION OF THE PREFERRED EMBODIMENTS

Figure 1:
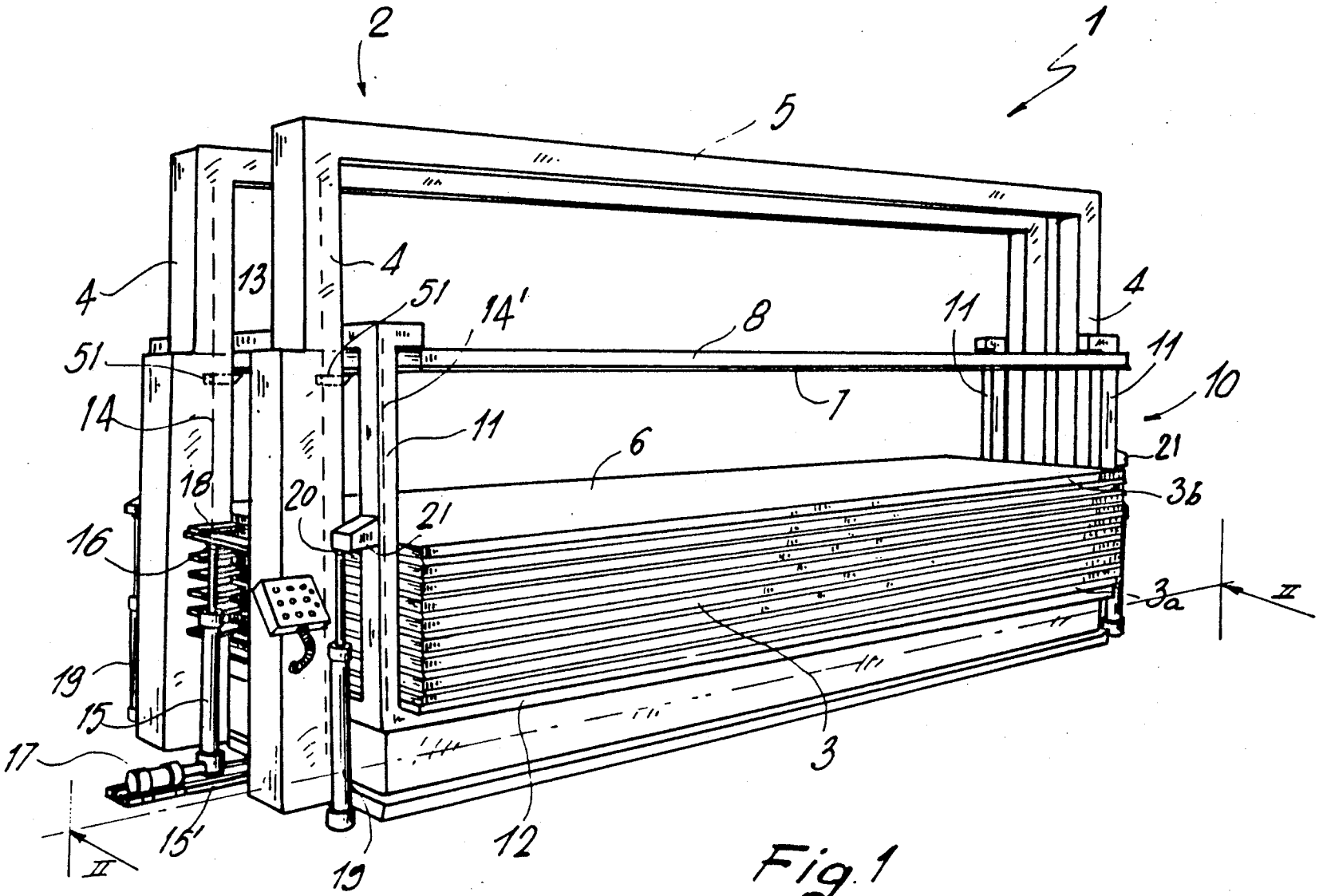
FIG. 1 is a perspective view of a drying machine according to the present invention.

With reference to the above-described figures, the vacuum drying machine according to the present invention, generally indicated by the reference numeral 1, comprises a fixed supporting frame 2 which supports a plurality of horizontal work tables 3. The supporting frame 2 comprises a pair, more preferably two pairs, of vertical uprights 4 which are fixed to the ground and are connected to one another at upper portions thereof by horizontal crosspieces 5.

In the embodiment illustrated in the drawings, the machine comprises eight work tables; in any case it is evident that in a practical execution the machine may be provided with any number of tables greater than two, without entailing substantial modifications of the invention's general concept.

Every table 3 has an upper face 6, on which the hide or hides to be dried are placed, and a lower face 7, which is intended to cooperate with the upper face of the underlying table. Except for the lowermost table, indicated by 3*a*, all of the tables 3 have their lower face 7 in the shape of a cover or collector, provided with a circumferential sealing gasket adapted to sealingly engage a corresponding peripheral portion of the upper face 6 of the underlying table, so as to define an evaporation chamber in which the hides are enclosed during drying. A fixed upper cover 8 is arranged above all of the tables and is intended to cooperate with the uppermost work table. Each table comprises per se known means for heating the hides and for condensing the vapors extracted from said hides.

According to the invention, an intermediate structure, generally indicated by reference numeral 10, is interposed between the supporting frame 2 and the work tables 3. Said structure 10 is substantially formed by a pair, more preferably two pairs, of vertical elements 11 arranged proximate to each upright 4 of the supporting frame. Said elements 11 are connected to one another at least at lower portions thereof, for example by means of side members 12 and crosspieces 13 so as to define an essentially parallelepipedal table-carrier frame or slider. The uprights 4 furthermore have vertical guides, schematically indicated by broken lines 14, along which the structure 10 can move vertically by means of corresponding sliding means such as wheels or skids.

The elements 11 of the structure 10 advantageously have, on their opposite walls, vertical guides 14' along which the tables 3 can slide vertically and parallel to themselves. From the above it is evident that the tables 3 can slide telescopingly with respect to the fixed supporting frame 2 and therefore the position of each table depends on its relative position with respect to the movable structure 10 and on the position of said movable structure with respect to the fixed supporting frame 2.

The supporting structure 2 furthermore comprises a plurality of safety and locking bolts 51 which automatically engage appropriate ledges or other equivalent elements rigidly associated with the tables 3. Said bolts may be controllably retracted, for example by means of hydraulic actuators not illustrated in the figures, to allow the descent of the tables 3. Per se known mechanical elements ensure the parallel arrangement of the tables as they are moved.

According to the invention, actuation means are conveniently provided to move the tables 3, which means are adapted to act selectively on each individual table and partly on the intermediate structure 10.

In a preferred embodiment, the actuation means preferably comprise a first pair of hydraulic cylinders 15 which are arranged between the uprights 4 of the supporting frame 2 so as that they can act simultaneously and selectively on each individual table 3. The jackets of the cylinders 15 rest on the ground and can slide along horizontal guides 15' rigidly associated with the base of the machine. Actuators 17, for example of the hydraulic type, are connected to the base of said jackets to slide the cylinders 15 horizontally. The piston rods of the cylinders 15 are movable and have, at their free ends, a coupling device in the form of a crosspiece 16 which can engage pairs of supports 18 rigidly fixed to the ends of the tables adjacent to the cylinders 15. By activating the actuators 17, the cylinders 15 slide along the guides 15', allowing the crosspieces 16 to selectively engage with the pairs of supports 18, in order to raise or lower each table 3.

Figures 2, 3, 4:
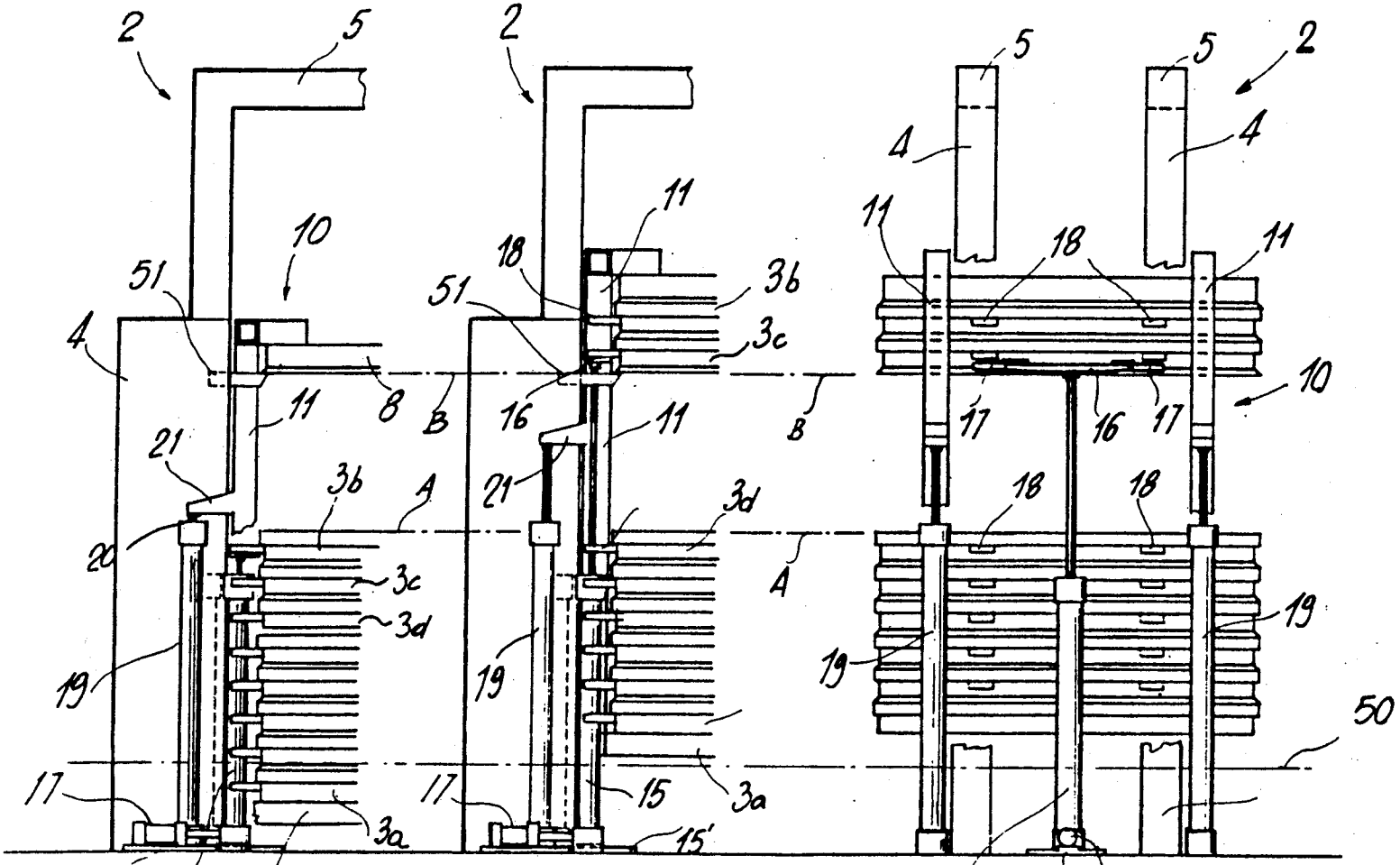
FIG. 2 is a sectional front view of a portion of the machine of FIG. 1, taken along the line II—II, with some parts of the structure removed for the sake of clarity.
FIG. 3 is a view similar to FIG. 2, illustrating a subsequent step of the machine's operation.
FIG. 4 is a side view of the portion of the machine shown in FIG. 3.

All of the tables are initially gathered in a pack on the bottom of the structure 10, which is also in its lowest position with respect to the frame 2, as shown in FIGS. 1 and 2. The uppermost table 3*b* of the pack is arranged at a preset level A, at a height h which is optimum for the assigned personnel, who stand on a work platform which extends laterally to the machine and is schematically indicated by a broken line 50. In this condition, the upper cover 8 is at a level B which is spaced from level A by a distance $\delta h$ equal to the height of the optimum space for applying the hides.

After completing the arrangement of the hides on the first table 3*b* of the pack, which is at level A, said table can be raised to place the hides on the second table. In this manner the first table is raised by a distance $\delta h$ so that its upper face is in contact with the upper cover 8 to delimit therewith a sealed evaporation chamber. When the stroke of the first table 3*b* is extended by a second portion approximately equal to the thickness s of each table, the entire structure 10 is raised so that the second table is moved such that its upper face is brought to the initial level A.

From the above it is evident that the hydraulic cylinders must each time perform a fixed lifting stroke equal in length to $\delta h+s$, except for small movements adapted to actuate the bolts 51.

According to a further aspect of the present invention, means are provided to control the movement of the intermediate structure 10. Said control means comprise at least one pair, preferably two pairs, of second hydraulic cylinders 19 which are connected to respective vertical elements 11 of the intermediate structure 10. The jackets of the cylinders 19 are fixed to the ground or to the base of the machine, while their piston rods have, at their free ends, supports 20 operatively engaged with corresponding connecting brackets 21 rigidly associated with the vertical elements 11.

Figure 6:
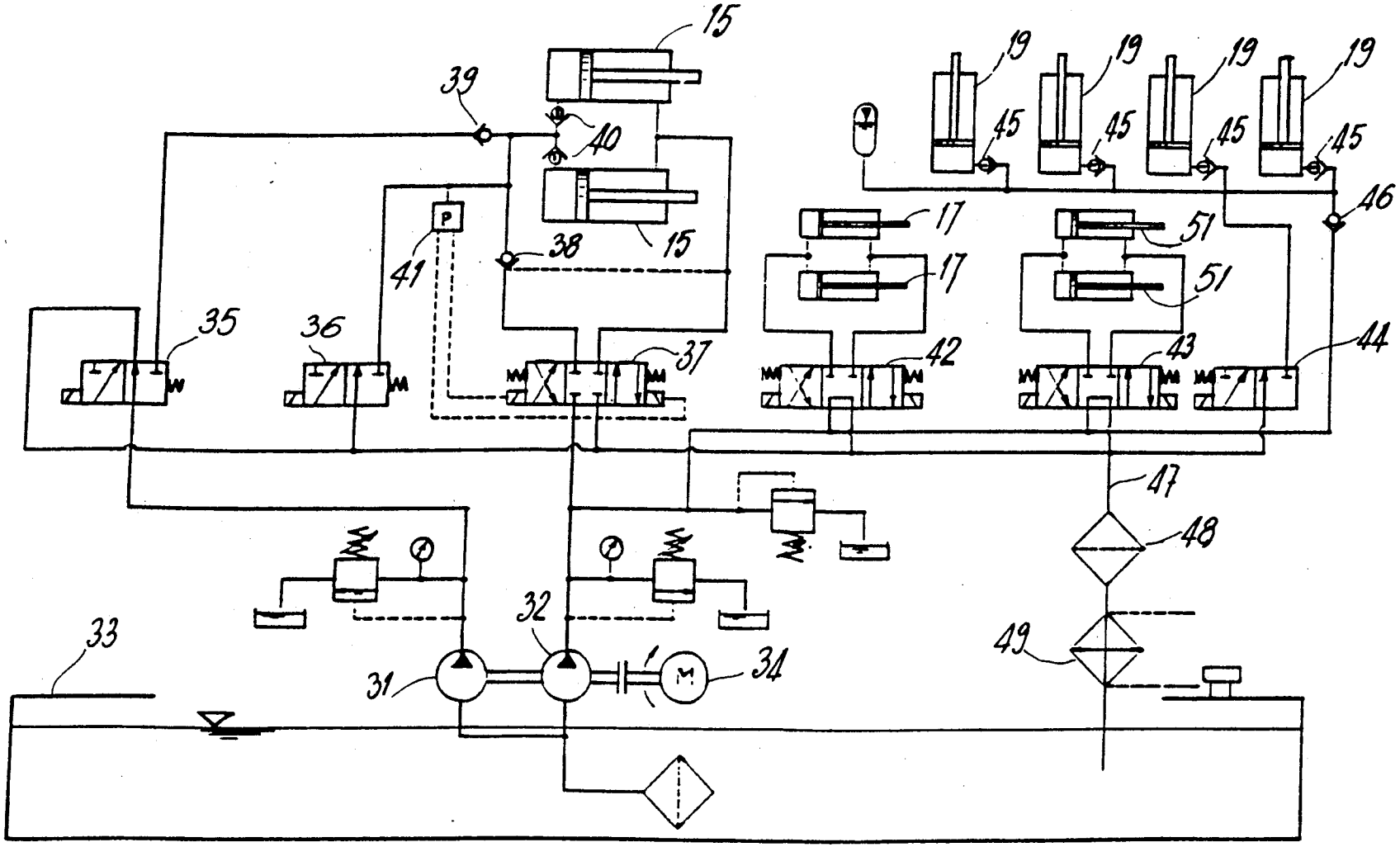
FIG. 6 is a hydraulic circuit diagram of part of the hydraulic system which controls the movement system of the machine according to the present invention.

As shown in FIG. 6, the cylinders 15 and the cylinders 19 are fed by respective independent hydraulic circuits.

Both circuits are fed by two pumps 31 and 32 which are actuated by a same motor 34 and which draw oil from a collecting tank 33. The first pump 31 delivers oil with a low flow-rate and a high pressure; the second pump 32 delivers oil with a high flow-rate and low pressure. The circuit of the cylinders 15 furthermore comprises two two-position solenoid valves 35 and 36, a three-position solenoid valve 37, a one-way pilot-operated valve 38, a one-way valve 39 and one-way calibrated-port valves 40 in the input line to the lower chamber of each cylinder 15. The solenoid valves 35 and 36, together with the hydraulically pilot-operated valve 38, feed the cylinders respectively during the raising of tables 3, while the electric valve 37 controls the feed of the cylinders 15 during a slow lowering and raising of table 3. A two-contact pressure switch 41 is disposed downstream of the solenoid valve 36 to automatically change the movement of the cylinders from low to high speed. The pilot-operated solenoid valve 42 actuates the cylinders 17, which cause the horizontal sliding of the cylinders 15 and therefore of the crosspieces 16, while the three-position solenoid valve 43 actuates the retraction of the safety bolts 51 of the tables.

The feed circuit of the cylinders 19 comprises a two-position solenoid valve 44, a one-way calibrated-port valve 45 at the inlet of each cylinder 19 and a one-way valve 46.

The oil recirculates to the collection tank 33 by means of a return line 47 which has a filter 48 and an exchanger 49.

Figure 5:
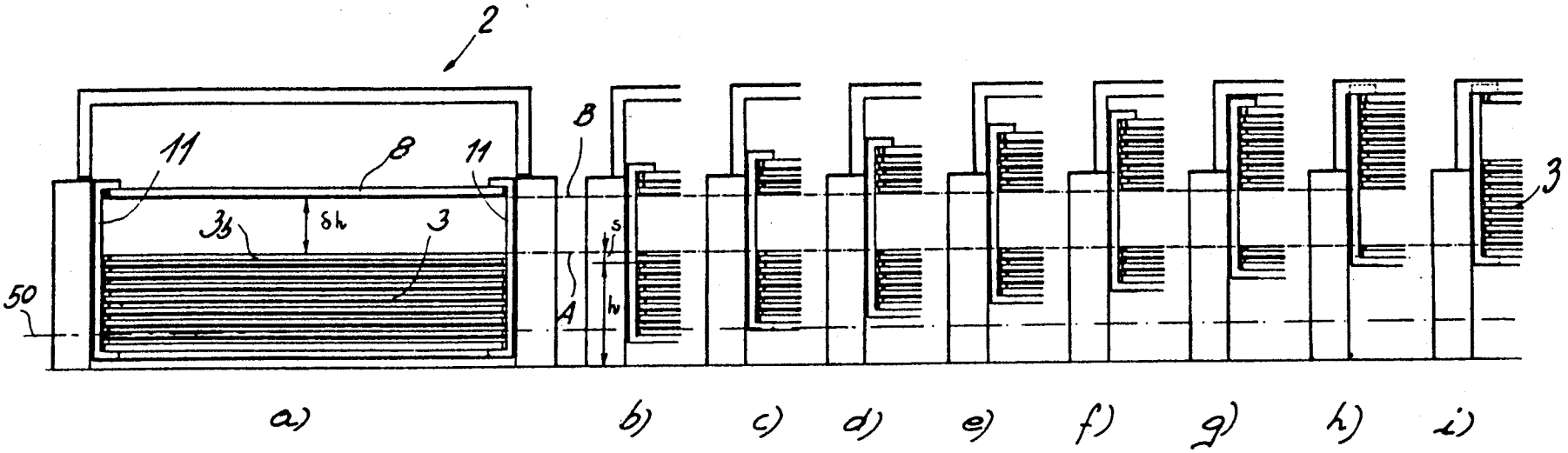
FIGS. 5*a* to 5*i* illustrate some successive steps of the operation of a machine according to the present invention.

The operation of the table movement system is schematically illustrated in FIG. 5 and can be summarized as follows.

The tables are initially stacked in the positions shown in FIG. 5*a*. The actuators 17 are actuated so that the crosspieces 16 engage with the uppermost pairs of supports 18. The movable element of the electric valve 37 is moved to the left and the movable element of the valve 35 is simultaneously moved to the right, so as to feed the cylinders 15 with oil at a high flow-rate and low pressure, arriving from both pumps, so as to rapidly raise the first table until it abuts against the upper cover 8. At this stage the pressure switch 41 detects a rise in pressure which moves the valve 37 to its central closure position, while the electric valve 35, which controls the feed of the hydraulic cylinders 15 at a low flow-rate and high pressure, remains in position. In this manner the first table slowly rises to level B and the entire movable structure 10, with all the remaining platforms, moves until the second table is moved to level A, as illustrated in FIG. 5*b*. In this ascending step the cylinders 19 are fed with oil at a low pressure which is sufficient to extend them without causing vacuums in their chambers. In this position, the generation of suction can begin in the drying chamber delimited between the table 3*b* and the cover 8, while the operator places the hides on the second table. The safety bolts simultaneously start to operate, retaining in place the first table, in which a vacuum has been produced.

In order to raise the second table, the cylinders 15 are retracted to move the crosspieces 16 to the level of the corresponding pairs of supports 18 of the second table 3*c*.

The actuators 17 simultaneously retract to allow the crosspieces 16 to engage the pairs of supports 18.

At this stage a new ascending step can begin for the second table 3*c*, so as to move it to the position illustrated in FIG. 5*c*. FIGS. 5*d* to 5*h* schematically illustrate the relative positions of the tables with respect to the movable structure 10 and of said structure 10 with respect to the fixed frame 2 in the successive ascending steps of the tables.

Once the last table 3*a* is raised, the cylinders 15 must lower the pack of tables 3 along the structure 10 so as to make the entire load bear on the cylinders 19. To this end the cylinders 15 are caused to slide outwards along the guides 15', so as to avoid any interference with the supports 18. At this stage the structure 10 and all of the tables 3 are moved to the position illustrated in FIG. 5*a*.

The descent of all of the tables in a pack, from the position illustrated in FIG. 5*h* and the descent of the structure 10 with all of the tables 3 lowered thereon are controlled by the cylinders 19 due to the shift of the electric valve 44. The discharge is controlled by the one-way calibrated-port valves 45 so as to return the structure 10 and tables 3 to the initial position schematically illustrated in FIG. 5*a*.

From what has been described above it is evident that the aim and objects of the present invention have been achieved, and in particular that a drying machine has been provided which has a greater number of tables than the prior art so as to make the production process economically advantageous. The object of using extremely simplified and small-size movement means is also achieved, consequently reducing the machine's production and maintenance costs.

The invention thus conceived is susceptible to numerous modifications and variations, all of which are within the scope of the inventive concept. By way of example, instead of the sliding guides 15' it is possible to use hinges, about which the cylinders can controllably oscillate to cause the crosspiece 16 to engage or not engage the pairs of supports 18.

All of the elements may furthermore be replaced with other technically equivalent elements and in practice the materials employed, so long as compatible with the contingent use, as well as the dimensions, may be any according to particular requirements and to the state of the art.

I claim:

1. A drying machine for drying industrial hides, said machine comprising: a fixed supporting frame; a plurality of work tables which extend substantially horizontally and are vertically movable with respect to said fixed supporting frame, each of said tables having, on its upper face, a plate for supporting and heating the hides and, on its lower face, a sealing closure cover which can engage the upper face of the underlying table to define a hide drying chamber therebetween; and an intermediate supporting structure which is vertically movable within said fixed supporting frame, said plurality of tables being in turn vertically movable inside said intermediate supporting structure to telescopingly slide with respect to said fixed supporting frame.

2. A drying machine according to claim 1, wherein said fixed supporting frame comprises at least one pair of fixed vertically extending uprights which are disposed proximate the longitudinal ends of said plurality of tables.

3. A drying machine according to claim 2, wherein said movable intermediate supporting structure comprises at least one pair of vertically extending elements which are rigidly connected to one another so as to define a rigid frame which extends between the uprights of said fixed supporting frame, said uprights comprising first vertical guiding means for guiding said rigid frame vertically relative to said fixed supporting frame.

4. A drying machine according to claim 3, further comprising second guiding means rigidly associated with said vertically extending elements for guiding said plurality of tables internally of said intermediate supporting structure.

5. A drying machine as claimed in claim 1, further comprising single movement means for moving said plurality of tables vertically, said single movement means being selectively and successively associable with each of said tables to move each one of said tables in each instance with respect to the remaining tables and with respect to said intermediate supporting structure.

6. A drying machine as claimed in claim 5, wherein said movement means interacts with said intermediate supporting structure to move it vertically with respect to said fixed supporting frame.

7. A drying machine as claimed in claim 6, wherein said movement means comprises at least one pair of first double-action hydraulic cylinders which are vertically extendable and retractable proximate the longitudinal ends of said plurality of tables.

8. A drying machine as claimed in claim 7, further comprising an upper cover fixed relative to said intermediate supporting structure, and wherein said first hydraulic cylinders have a fixed stroke of a first part and a second part, said hydraulic cylinders raising a single table until it abuts against the immediately adjacent table or against said upper cover during the first part of the stroke thereof, and said hydraulic cylinders raising said intermediate supporting structure together with said plurality of tables during the second part of the stroke thereof.

9. A drying machine as claimed in claim 8, wherein said first part of said fixed stroke is substantially equal to the height of the optimum access space for the placing of the hides on the part of the assigned personnel.

10. A drying machine as claimed in claim 9, wherein said second part of said fixed stroke is approximately equal to the thickness of each of said tables.

11. A drying machine as claimed in claim 10, wherein said first hydraulic cylinders have fixed jackets , and movable piston rods which have, at their free ends, support members which can engage each of said tables, and said movement means includes fixed longitudinal guides on which said fixed jackets are slidably supported, and actuation means for sliding said first cylinders along said longitudinal horizontal guides.

12. A drying machine as claimed in claim 11, wherein each of said tables includes pairs of supports extending therefrom, and said support members which can engage the tables comprise horizontal crosspieces adapted to engage or not engage with said pairs of supports depending on the position of said first cylinders along said longitudinal horizontal guides.

13. A drying machine as claimed in claim 11, further comprising means for moving said intermediate supporting structure vertically relative to said fixed supporting frame, said moving means comprising at least one pair of second single-action vertically oriented hydraulic cylinders having jackets fixed relative to the ground and movable piston rods, and wherein connection brackets are rigidly connected to said vertically extending elements, free ends of the piston rods of said second hydraulic cylinders respectively supporting said brackets.

14. A drying machine as claimed in claim 13, further comprising a first hydraulic circuit for controlling movement of said first hydraulic cylinders, and a respective second hydraulic circuit for controlling movement of said second hydraulic cylinders.

15. A drying machine as claimed in claim 14, wherein said first and second hydraulic circuits comprise two hydraulic pumps, the first of said pumps pumping oil at a low flow-rate and high pressure, and the second of said pumps pumping oil at a high flow-rate and low pressure.

16. A drying machine as claimed in claim 15, wherein said first hydraulic circuit further comprises a plurality of pilot-operated solenoid valves adapted to selectively connect said first pump and said second pump with said first cylinders to move them selectively at a slow rate and at a fast rate.

17. A drying machine as claimed in claim 16, wherein said second hydraulic circuit comprises a pilot-operated solenoid valve interposed between said second hydraulic cylinders and said pumps, and a one-way calibrated-port valve provided between said electric valve and each of said second cylinders.

* * * * *